US006305576B1

(12) United States Patent
Leoncavallo

(10) Patent No.: US 6,305,576 B1
(45) Date of Patent: Oct. 23, 2001

(54) CARTRIDGE FOR ASEPTICALLY HOLDING AND DISPENSING A FLUID MATERIAL, AND A CONTAINER AND METHOD FOR ASEPTICALLY HOLDING AND MIXING THE FLUID MATERIAL

(75) Inventor: Richard A. Leoncavallo, Pittsford, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 0 days.

(21) Appl. No.: 09/487,069

(22) Filed: Jan. 19, 2000

(51) Int. Cl.[7] ..... B65D 41/00

(52) U.S. Cl. ..... 222/83.5; 222/88; 222/325; 222/1; 215/6; 215/DIG. 8; 206/222

(58) Field of Search ..... 222/1, 81, 83, 222/83.5, 88, 325; 206/222; 215/6, DIG. 8

(56) References Cited

U.S. PATENT DOCUMENTS

| | | | | |
|---|---|---|---|---|
| D. 389,412 | | 1/1998 | Klima, Jr. et al. | D9/524 |
| 2,631,521 | * | 3/1953 | Atkins, Jr. | 206/222 |
| 4,221,291 | * | 9/1980 | Hunt | 206/222 |
| 4,638,927 | * | 1/1987 | Morane | 222/83 |
| 4,798,287 | * | 1/1989 | Groves et al. | 215/DIG. 8 |
| 5,029,718 | * | 7/1991 | Rizzardi | 206/222 |
| 5,255,812 | * | 10/1993 | Hsu | 206/222 |
| 5,529,216 | | 6/1996 | Klima et al. | 222/130 |
| 5,772,017 | * | 6/1998 | Kang | 206/222 |
| 5,884,759 | * | 3/1999 | Gueret | 206/222 |

* cited by examiner

*Primary Examiner*—J. Casimer Jacyna
(74) *Attorney, Agent, or Firm*—Wood, Herron & Evans, L.L.P.

(57) ABSTRACT

A container, cartridge and method for holding, dispensing and mixing a fluid material comprised of at least two component fluids in an aseptic manner. A cartridge includes a cartridge body for holding one component fluid and having first and second ends. A seal is affixed to the first end of the cartridge body and a movable portion is sealed to the second end of the cartridge body. A movable member is fully disposed within the cartridge body and aseptically sealed between the first and second ends. The movable member may be moved in response to movement of the movable portion at the second end such that the movable member breaks the seal and the fluid material is thereby dispensed from the first end. This allows a fluid component, such as a concentrate, to be readily mixed with another fluid, such as water, under aseptic conditions and immediately contained within an aseptic environment of the container.

21 Claims, 4 Drawing Sheets

CARTRIDGE FOR ASEPTICALLY HOLDING AND DISPENSING A FLUID MATERIAL, AND A CONTAINER AND METHOD FOR ASEPTICALLY HOLDING AND MIXING THE FLUID MATERIAL

FIELD OF THE INVENTION

The present invention generally relates to fluid containers and, more specifically, to aseptic containers for holding, mixing and/or dispensing fluids comprised of at least two different fluid components.

BACKGROUND OF THE INVENTION

Fluids of various types must be stored, shipped, handled and often mixed in containers suitable for the intended application. As used herein, the term "fluid" may refer to any material that can flow, including gases, liquids or particulate solids, such as powders. Often, fluid products are comprised of one or more toxic or potentially harmful substances and one or more non-toxic substances. For example, a concentrated chemical, which may have a toxicity harmful to humans and animals, is often mixed with water and used for various purposes. The uses may be household uses, laboratory or scientific uses, medical uses or other industrial applications. Especially in the case of laboratory, scientific or medical situations, aseptic conditions are often required for the fluid material or materials during storage, shipping, handling and use. Adequate precautions must be taken to prevent outside contaminants from reaching the fluid material within the container. This is typically easy to accomplish during the storage, shipping and handling phases of the product life when all of the fluid components have been mixed at the manufacturing site and sealed in the container until use.

More recently, the use of concentrates mixable with a non-toxic base fluid, such as water, has proliferated due to the associated convenience and environmental benefits. For example, many manufacturers of fluid products now sell concentrates that are mixed with water to form the end product. This reduces the amount of packaging necessary for the product being sold and allows the consumer to reuse a container in which the concentrate is mixed with the base fluid, such as water. Certain drawbacks of two-part systems in which the consumer must mix concentrate with another fluid, such as water, have been recognized in the art. For example, handling large bottles of concentrate can be inconvenient, unsafe and difficult. U.S. Pat. No. 5,529,216 addresses some of these general problems with specific regard to a spray bottle. In this regard, the user can puncture a concentrate insert in the spray bottle by using the draw tube of the spray bottle. Once the insert is punctured, the concentrate is released and mixes with water contained in the bottle.

One area in which problems remain with respect to two-part or multi-part fluid mixing systems is the area of aseptic fluid storage and handling. The product shown in U.S. Pat. No. 5,529,216 fails to address this problem as the use of the draw tube of a spray bottle can easily introduce outside contaminants into the fluid components within the bottle. For these reasons, it would be desirable to provide a fluid storage, handling and mixing system and components therefor that allow at least two fluid components to be mixed just prior to use while ensuring that the mixing takes place under aseptic conditions.

SUMMARY OF THE INVENTION

The present invention therefore provides a manner of safely and efficiently holding and subsequently mixing fluid materials in an aseptic manner within a container. In this regard, a first component fluid may be held in an aseptic manner and subsequently dispensed by a user or by other more automatic manners into a connected container holding a second component fluid while ensuring that the mixing takes place under completely aseptic conditions. The products and methods of this invention may be utilized for various flowable materials or fluids, such as powders, liquids or gases.

In accordance with one aspect of the invention, a cartridge is provided for holding and dispensing a fluid material in an aseptic manner. The cartridge generally includes a cartridge body for holding the fluid material and having first and second ends. A seal is affixed to the first end of the cartridge body and a movable portion is sealed to the second end. A movable member s disposed within the cartridge body and sealed, preferably in an aseptic manner, between the first and second ends. The movable member is moved in response to movement of the movable portion at the second end such that the movable member breaks or opens the seal and the fluid material is then dispensed from the first end.

In the preferred embodiment, the movable member comprises a piercing member mounted for linear movement within the cartridge body and adapted to piece through the seal when acted upon by the movable portion. Preferably, the movable portion of the cartridge is simply manually depressed by the user to push the piercing member through the seal. The seal may be a conventional foil and polymeric layered seal or another type of induction seal or otherwise openable seal structure. The movable portion of the cartridge may be a bellows-shaped portion adapted to manually depressed by a user to move the movable member toward the seal. Other types of movable actuating structure may be utilized as well.

As an alternative to a separately affixed seal at the first end of the cartridge body, the first end of the cartridge body may be an integral portion of the cartridge body, for example, molded integrally with the remaining portions of the cartridge body. In this case, the second end, or movable portion, may be separately affixed such that the fluid material may be introduced through the second end prior to sealing the movable portion thereto. Other manners of introducing the fluid may be devised by those of ordinary skill while retaining the preferred aseptic properties of the cartridge. As another alternative, the seal at the first end of the cartridge body may be configured to open at a predetermined temperature, such as just below an autoclave temperature or approximately 120° C.

The movable member may include a positioning portion which positions and stabilizes the movable member within the cartridge body. As one example, fins may extend radially outward from the movable member so as to center the movable member within the cartridge body, while allowing fluid to flow past the fins. Other manners of stabilizing the movable member within the cartridge body may be utilized as well, if necessary.

The cartridge can further comprise a connector portion operatively connected with the cartridge body. The connector portion is adapted to be affixed adjacent a cap assembly of a container such that the cartridge body extends into the container in position for dispensing the fluid material upon activation of the movable member. The connector portion may, for example, comprise a flange configured to engage the container and be removably received in an open end thereof.

As another aspect of the invention, a container is provided for holding a fluid material comprising at least two separate component fluids. The container includes a container body for holding the component fluids and having an opening. The opening receives the cartridge as described above. The container body may be flexible or rigid and may take on many different shapes and be formed of many different types of material and sizes. The opening that receives the cartridge may be a dispensing opening, for example, which includes a cap for selectively opening and closing the opening. Alternatively, the cartridge may communicate with the interior of the container body through a separate opening from a dispensing opening associated with the container. When used in conjunction with a cap on the opening, the cap may have a hole for allowing a user to access the movable portion of the cartridge such that the movable member may be manually or otherwise activated to dispense the fluid material from the cartridge body into the interior of the container body. Preferably, the cartridge is removable and replaceable with another cartridge when the application dictates that this desirable.

The present invention further contemplates a method of aseptically dispensing a first component fluid and mixing the first component fluid with at least one other component fluid in a container having at least one opening. The method generally includes containing the first component fluid in an aseptically sealed cartridge having a movable member sealed therein and retaining the cartridge in the opening of the container. The movable member is then actuated to dispense the first component fluid into the container and the first and second component fluid are then mixed within the container.

Various additional features, objectives and advantages of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
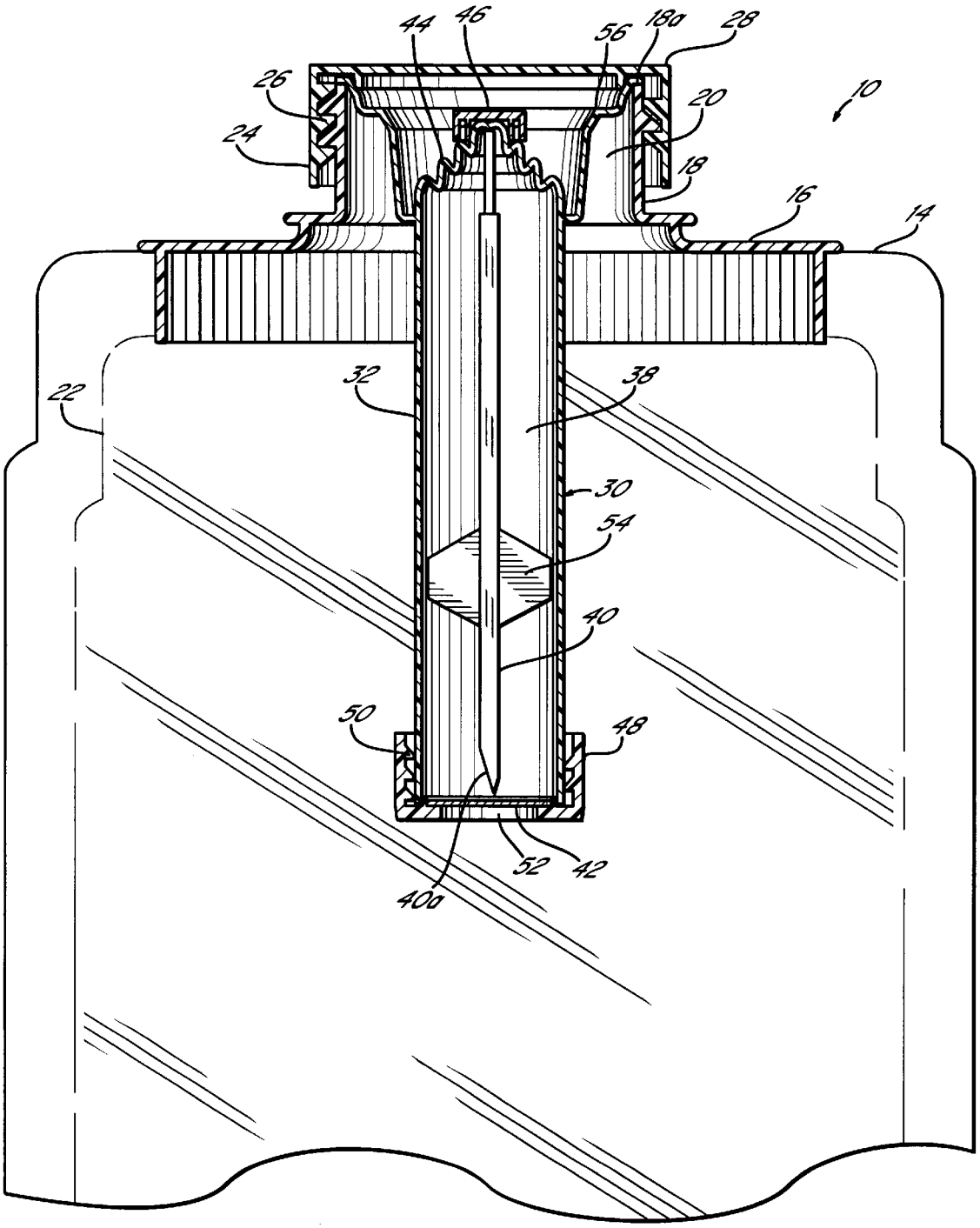
FIG. 1 is a fragmented, elevational view of a container constructed in accordance with the invention and showing portions thereof in axial cross section to show details of the dispensing cartridge of this invention.
Figure 2:
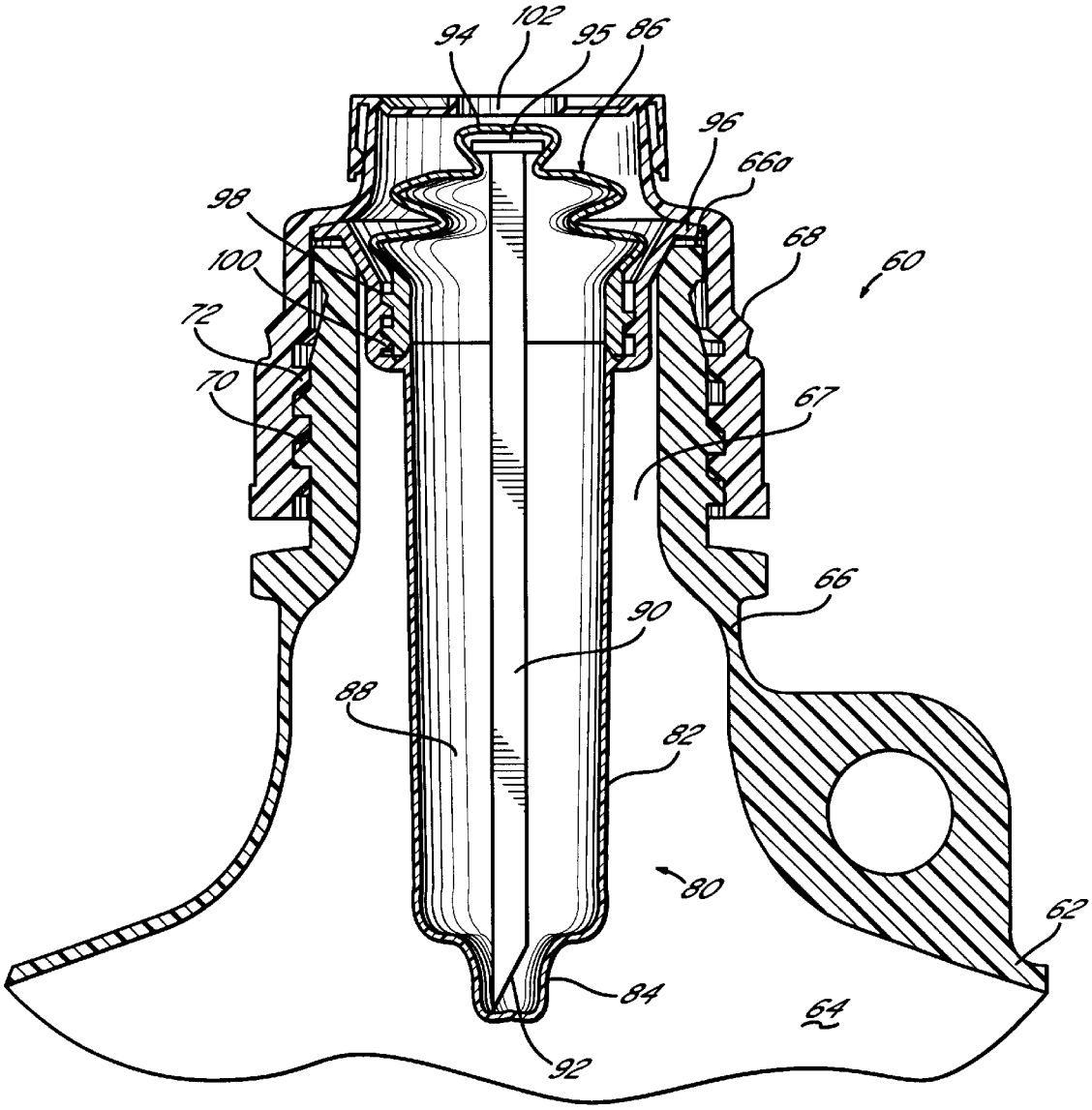
FIG. 2 is a fragmented cross sectional view of a similar container, but showing an alternative cartridge and container configuration in accordance with the invention.
Figure 3:
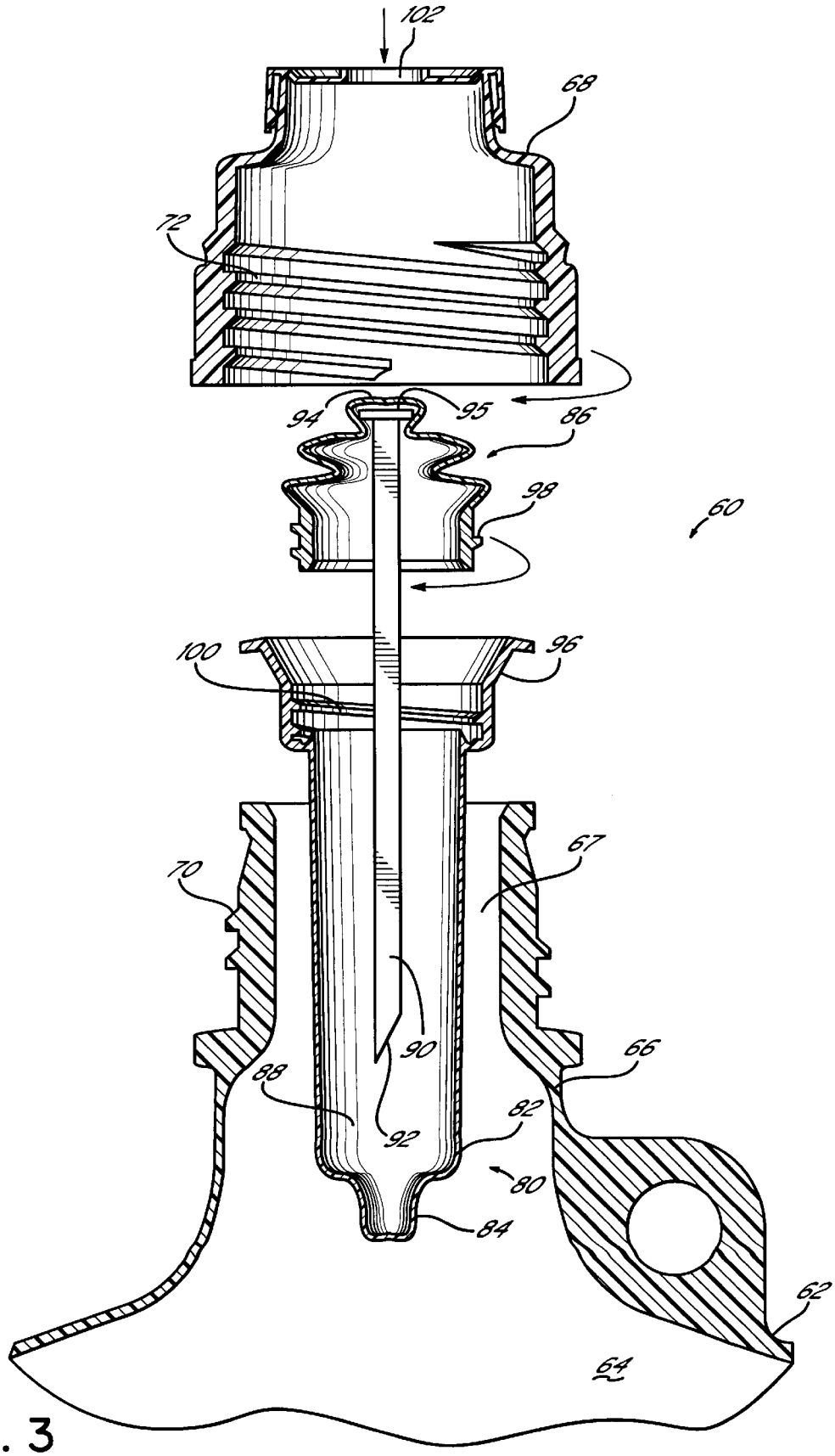
FIG. 3 is an exploded view of the container and cartridge assembly shown in FIG. 2.

FIG. 1 illustrates a first embodiment of the invention in the form of a container 10. Container 10 includes a container body 12 fragmented at a lower end for illustrative purposes only. Container body 12 may comprise, for example, a flexible plastic bag, as shown, or may be sized, configured and shaped in any other manner and constructed from other materials having properties suitable for the intended application. Container body 12 includes an upper end 14 which is a portion of the bag that has been sealed or adhesively secured to a rigid plastic portion 16 including a spout or neck 18. Neck 18 includes an opening 20 for accessing an interior 22 of container body or bag 12. Neck 18 includes external threads 24 which engage internal threads 26 associated with a cap 28. This allows cap 28 to be selectively threaded onto and unthreaded from neck 18 to access the interior of container body 12 and to dispense contents thereof.

In accordance with a preferred aspect of the invention, an aseptic dispensing cartridge 30 is received within opening 20 and includes a cartridge body 32 having a first end 34 and a second end 36, respectively shown as the lower and upper ends of cartridge body 32. It will be understood that any reference to terms of orientation, such as "upper" and "lower" are not to be construed in a limiting sense as the various elements associated with the invention may be utilized in various orientations other than those shown. Cartridge body 32 includes an interior 38 adapted to receive a component fluid, such as a concentrate, to be subsequently mixed with another component fluid contained within interior 22 of container body 12. The interior 38 of cartridge body 32 includes a movable member 40 mounted for reciprocation and preferably having a sharpened end 40*a*. Movable member 40 is shown as a separate element but may be connected with cartridge body 32. The movable member of this invention may also take on many other configurations and may be integrally formed with the cartridge body. First end 34 includes a seal 42, which may be an induction seal or another type of seal that is adhesively secured, welded or otherwise securely affixed to first end 34 of container body 32. In accordance with the preferred embodiment, this aseptically seals any contents within interior 38 until seal 42 is broken or opened. Second end 36 of cartridge body 32 includes a movable portion 44 which may be in the preferred form of a generally bellows-shaped configuration, as shown, or may take any other appropriate form facilitating movement of member 40. A cap 46 is disposed on top of movable portion 44 and simply provides a larger, more rigid contact surface for a user, as described further below. A cap 48 at the opposite end may be used to help secure and retain seal 42 in place. Cap 48 may be secured, for example, by threads 50 and includes a hole 52 for exposing at least a central portion of seal 42.

Fins 54 extend radially outward from movable member 40 and serve to center and stabilize movable member 40 for reciprocating motion within interior 38. It will be appreciated that other types of positioning structure may be provided on cartridge body 32 or movable member 40, or both, for facilitating this positioning and stabilizing function, if deemed necessary.

In operation, and as one example, a user may remove cap 28 and if cartridge 30 is in place, remove cartridge 30. This allows water or another first component fluid to be introduced into interior 22 of container body 12. Cartridge 30 may then be reinserted through opening 20 such that flange 56 rests on the top edge 18*a* of neck 18. Cap 46 may then be manually depressed by the user to move bellows-shaped portion 44 and movable member 40 downward such that sharpened end 40*a* pierces through seal 42. This dispenses the component fluid, such as a concentrate, from interior 38 into interior 22 in an aseptic manner allowing mixing of the two component fluids within interior 22. It will be appreciated that the component fluid within interior 38 of cartridge 30 is not exposed to the ambient environment during this process and any potential contaminants from the ambient environment are also not introduced into interiors 22 or 38 during this mixing process.

Another embodiment of the invention is shown in FIGS. 2, 3 and 4A–B. In these drawings, a container 60 incorporating principles of the present invention has also been shown in an enlarged and fragmented manner for clarity. Container 60 includes a container body 62 which may be formed from any of numerous materials, but is shown for illustrative purposes to be formed of a plastic, such as polyethylene. Container body 62 includes an interior 64 and further includes a neck 66 having an opening 67 communicating with interior 64. A cap 68 is received on neck 66 and securely affixed to external threads 70 on neck 66 and internal threads 72 on cap 68.

A cartridge 80, constructed in accordance with the inventive principles, is inserted into opening 67 of neck 66 so that it may communicate with interior 64 during use. Cartridge 80 includes a cartridge body 82 having a first end 84 and a second end 86 defining an interior 88 therebetween. A movable member 90, in the form of a reciprocating rod, is mounted within interior 88 and includes a sharpened or converging end 90*a*. First end 84 of cartridge body 82 defines a sealed, but frangible or breakable end 92. A movable portion 94, in the form of a bellows-shaped cap 94 connected with cartridge body 82 is affixed at second end 86. A flat head 95 of movable member 90 is received within an uppermost portion of the bellows configuration. A flange 96 extends integrally from cartridge body 82. The bellows-shaped movable portion or cap 94 is affixed to flange 96 by threads 98 engaging threads 100 of flange 96.

Figure 4B:
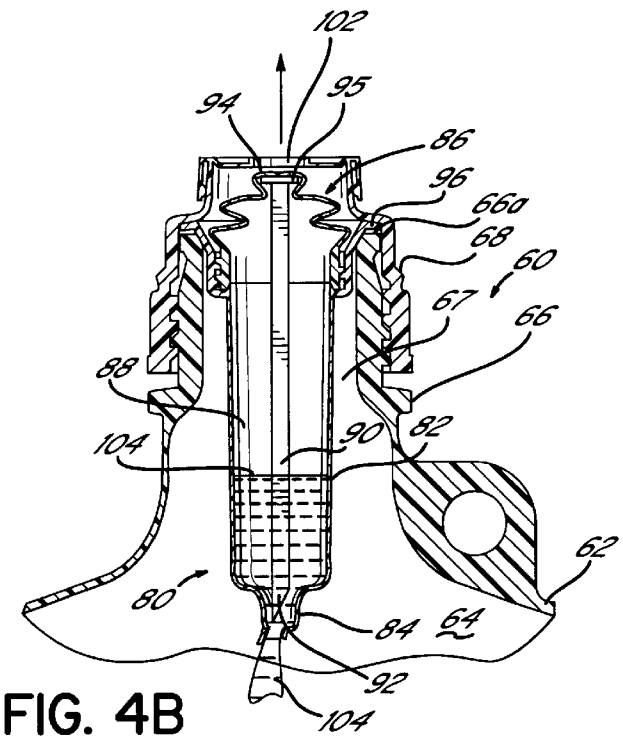
FIGS. 4A and 4B are views similar to FIG. 2, but showing the manner of operation associated with this second embodiment of the invention.
Figure 4A:
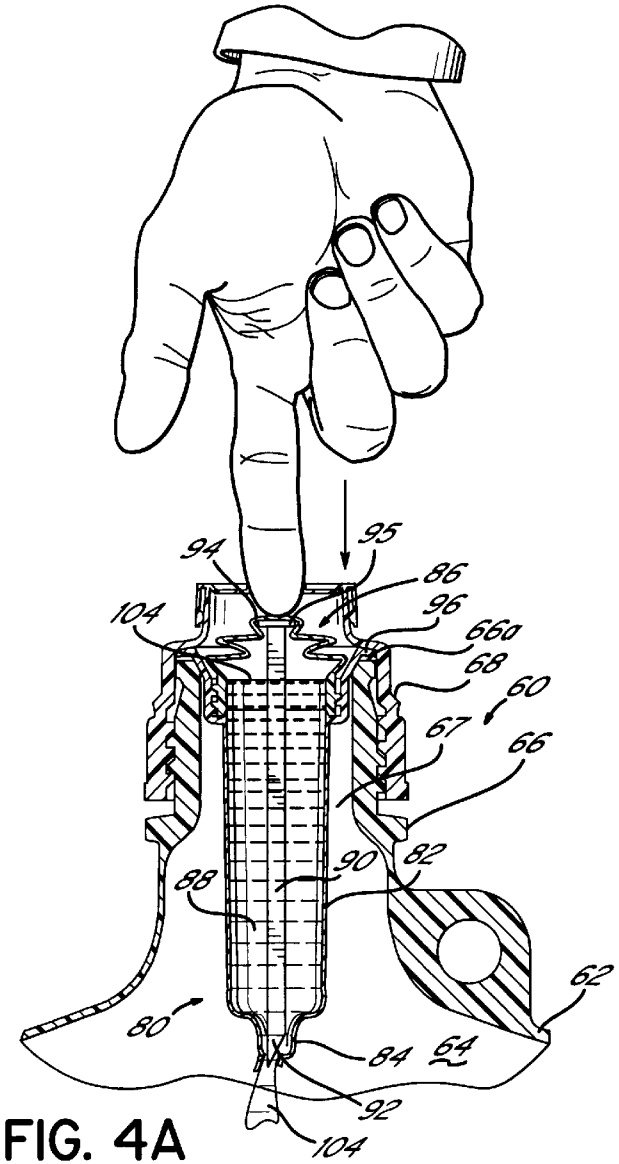

As illustrated best in FIGS. 4A and 4B, a user may access and depress bellows-shaped portion 94 by inserting their finger through a hole 102 in the upper surface of cap 68. By depressing the bellows-shaped cap 94, movable member 90 is pushed through the sealed end 92 thereby breaking or otherwise opening this sealed end to allow fluid to dispense from the interior 88 of cartridge body 82 to the interior 64 of the container body 62. As shown in FIG. 4B, upon release of pressure from the bellows shaped portion 94, movable member 90 preferably springs back upwardly due to forces of the bellows-shaped portion 94 thereby removing end 92 from the opening previously created and allowing better flow of fluid from interior 88.

As one additional alternative, the invention may include a heat activated, releasable seal structure. This may be substituted for the seal structures shown in the drawings and may open the seal at a predetermined temperature, such as a temperature approaching a conventional autoclave temperature of 120° C. For example, an adhesive may be used on the induction seal that releases at this temperature to break the sealed connection between the cartridge body and the seal structure.

From the foregoing description, it will be appreciated that the present invention provides a container in the form of a cartridge and mixing and/or dispensing system that provides storage, shipping and mixing of toxic or otherwise potentially harmful fluid materials in a convenient and aseptic manner. In addition to the advantageous aseptic properties of the cartridge associated with this invention, the invention significantly eases the shipping of large amounts of toxic or potentially harmful fluid materials. With the cartridge of the present invention, shipment of hazardous materials, infectious materials, etc., may be made in smaller concentrated quantities and then easily mixed at the point of use in accordance with the invention. The use of smaller hazardous material containers reduces the likelihood of leakage since the closures associated with these containers are smaller and more reliable.

While the present invention has been illustrated by a detailed description of a preferred embodiment, it is not the intention of the applicants to restrict or in any way limit the scope of the appended claims to such detail. Various features of the invention may be combined in various unique and advantageous manners to achieve objectives of the invention. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A cartridge for holding and dispensing a fluid material in an aseptic manner, the cartridge comprising:

a cartridge body having an interior for holding the fluid material and having first and second ends, a seal affixed to the first end of said cartridge body, a movable portion sealed to the second end of said cartridge body said seal and movable portion collectively aseptically sealing said cartridge interior, a movable member disposed within the interior of said cartridge body between the first and second ends, wherein said movable member may be moved in response to movement of said movable portion at the second end such that said movable member breaks the seal and the fluid material is thereby dispensed from the cartridge interior via the first end, and a connector portion operatively connected with said cartridge body, wherein said connector portion is adapted to be affixed adjacent a cap of a container and adapted to be removably and replaceably received in an open end of the container such that the fluid material may be dispensed into the container.

2. The cartridge of claim 1, wherein the movable member further comprises a piercing member mounted for linear movement within the cartridge body and adapted to pierce through the seal when acted on by the movable portion.

3. The cartridge of claim 1, wherein the movable portion of said cartridge body further comprises a bellows-shaped portion adapted to be manually depressed by a user to move the movable member toward the seal.

4. The cartridge of claim 1, wherein said seal further comprises an integral part of said cartridge body and said movable portion further comprises a separately affixable portion, wherein the fluid material may be introduced into said cartridge body at the second end and the separately affixable, movable portion may then be affixed to retain the fluid material therein.

5. The cartridge of claim 1 further comprising a positioning portion on the movable member for positioning and stabilizing the movable member within said cartridge body.

6. The cartridge of claim 1 wherein said connector portion further comprises a flange configured to engage the container.

7. A container for holding a fluid material comprising at least two separate component fluids, comprising:

a container body having an interior for holding the component fluids and having an opening, a cartridge body having first and second ends and received by the opening in said container body for initially holding and dispensing a first of said component fluids in an aseptic manner, a seal affixed to the first end of said cartridge body, a movable portion sealed to the second end of said cartridge body, a movable member disposed within said cartridge body and aseptically sealed between the first and second ends, wherein said movable member may be moved in response to movement of said movable portion at the second end such that said movable member breaks the seal and the first component fluid is thereby dispensed from the first end, and a connector portion operatively connected with said cartridge body, wherein said connector portion is engageable with the container body and is configured to be removably and replaceably received in the opening of said container body such that the fluid material may be dispensed into the interior of the container body.

8. The container of claim 7, wherein the movable member further comprises a piercing member mounted for reciprocation within the cartridge body and adapted to pierce through the seal when acted on by the movable portion.

9. The container of claim 7, wherein the movable portion of said cartridge body further comprises a bellows-shaped portion adapted to be manually depressed by a user to move the movable member toward the seal.

10. The container of claim 7, wherein said seal further comprises an integral part of said cartridge body and said movable portion further comprises a separately affixable portion, wherein the first component fluid may be introduced into said cartridge body at the second end and the separately affixable, movable portion may then be affixed to retain the first component fluid therein.

11. The container of claim 7 further comprising a positioning portion on the movable member for positioning and stabilizing the movable member within said cartridge body.

12. The container of claim 10 wherein said connector portion further comprises a flange configured to engage the container body.

13. The container of claim 12, wherein the container further includes a neck and the opening is in said neck, and further comprising a cap engageable with said neck and covering said opening.

14. The container of claim 13, wherein said cap includes a hole for accessing the movable portion of said cartridge body.

15. A method of aseptically dispensing a first component fluid and mixing the first component fluid with a second component fluid in a container having at least one opening, the method comprising:

containing the first component fluid in an aseptically sealed cartridge having a movable member sealed therein, removably and replaceably retaining the cartridge in the opening of said container, actuating the movable member to dispense the first component fluid into the container, and mixing the first component fluid with the second component fluid in the container.

16. The method of claim 15, wherein actuating the movable member further comprises breaking a seal on the cartridge using the movable member.

17. The method of claim 16, wherein breaking the seal further comprises piercing through the seal with a sharpened end of the movable member.

18. The method of claim 15, wherein actuating the movable member further comprises depressing an outside portion of the cartridge.

19. The method of claim 15, wherein removably retaining the cartridge further comprises engaging a flange of the cartridge with a neck surrounding the opening of the container.

20. A cartridge for holding and dispensing a fluid material in an aseptic manner, the cartridge comprising:

a cartridge body having an interior for holding the fluid material and having first and second ends, a seal affixed to the first end of said cartridge body, said seal further comprising a separate seal affixed to the first end of said cartridge body wherein the fluid material may be introduced into said cartridge body through the first end and the separate seal may then be affixed to retain the fluid material therein, and wherein said seal is configured to open at a predetermined temperature, a movable portion sealed to the second end of said cartridge body, said seal and movable portion collectively aseptically sealing said cartridge interior, a movable member disposed within the interior of said cartridge body between the first and second ends, wherein said movable member may be moved in response to movement of said movable portion at the second end such that said movable member breaks the seal and the fluid material is thereby dispensed from the cartridge interior via the first end.

21. A container for holding a fluid material comprising at least two separate component fluids, comprising:

a container body for the component fluids and having an opening, a cartridge body having first and second ends and received by the opening in said container body for initially holding and dispensing a first of said component fluids in an aseptic manner, a seal affixed to the first end of said cartridge body, said seal further comprising a separate seal affixed to the first end of said cartridge body wherein the first component fluid may be introduced into said cartridge body through the first end and the seal may then be affixed to retain the first component fluid therein, and wherein said seal is configured to open at a predetermined temperature, a movable portion sealed to the second end of said cartridge body, a movable member disposed within said cartridge body and aseptically sealed between the first and second ends, wherein said movable member may be moved in response to movement of said movable portion at the second end such that said movable member breaks the seal and the first component fluid is thereby dispensed from the first end.

* * * * *